US010035253B2

(12) United States Patent
Inagawa et al.

(10) Patent No.: US 10,035,253 B2
(45) Date of Patent: Jul. 31, 2018

(54) PORTABLE WORK TOOL

(71) Applicant: Hitachi Koki Co., Ltd., Tokyo (JP)

(72) Inventors: Hiroto Inagawa, Hitachinaka (JP); Kenji Fukuda, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 379 days.

(21) Appl. No.: 14/759,298

(22) PCT Filed: Jan. 8, 2014

(86) PCT No.: PCT/JP2014/000040
§ 371 (c)(1),
(2) Date: Jul. 6, 2015

(87) PCT Pub. No.: WO2014/112330
PCT Pub. Date: Jul. 24, 2014

(65) Prior Publication Data

US 2015/0352706 A1 Dec. 10, 2015

(30) Foreign Application Priority Data

Jan. 17, 2013 (JP) ..... 2013-006789

(51) Int. Cl.
*B25F 5/02* (2006.01)
*B25F 5/00* (2006.01)
(Continued)

(52) U.S. Cl.
CPC ..... *B25F 5/02* (2013.01); *B25F 5/006* (2013.01); *B25D 17/043* (2013.01); *B25D 17/24* (2013.01); *Y10T 16/476* (2015.01)

(58) Field of Classification Search
CPC ... B25F 5/00; B25F 5/02; B25F 5/006; B25D 17/043; B25D 17/24; B25D 2222/69; Y10T 16/466; Y10T 16/476
(Continued)

(56) References Cited

U.S. PATENT DOCUMENTS 4,648,468 A * 3/1987 Honsa ..... B25D 17/043 16/429
5,027,910 A * 7/1991 Honsa ..... B25D 17/24 173/162.1
(Continued)

FOREIGN PATENT DOCUMENTS

CN 1494996 A 5/2004
CN 101175611 A 5/2008
(Continued)

OTHER PUBLICATIONS

China Intellectual Property Office office action for application 201480003785.6 dated Sep. 1, 2016.
(Continued)

*Primary Examiner* — Scott A. Smith
(74) *Attorney, Agent, or Firm* — Kilpatrick Townsend & Stockton LLP

(57) ABSTRACT

A portable work tool includes: a housing; a motor; and a restraining surface. The housing has an outer surface including a covered region that is covered with a soft layer and an uncovered region that is exposed to an outside. The covered region and the uncovered region define a boundary therebetween. The motor is accommodated in the housing. The restraining surface is disposed in proximity to the boundary and protrudes from the covered region.

16 Claims, 11 Drawing Sheets

(51) Int. Cl.
*B25D 17/04* (2006.01)
*B25D 17/24* (2006.01)

(58) Field of Classification Search
USPC ..... 173/170, 162.1, 162.2, 210, 211, 213, 173/217; 16/421, 430
See application file for complete search history.

(56) References Cited

U.S. PATENT DOCUMENTS

| | | | | |
|---|---|---|---|---|
| 5,054,562 | A * | 10/1991 | Honsa | B25D 17/043 173/162.1 |
| 5,267,487 | A * | 12/1993 | Falco | B62D 1/06 428/36.1 |
| 7,018,142 | B2 | 3/2006 | Cooper | |
| 7,766,097 | B2 * | 8/2010 | Kondo | H01M 2/1066 173/162.2 |
| 2004/0013486 | A1 * | 1/2004 | Cooper | B25F 5/006 408/241 R |
| 2005/0155778 | A1 * | 7/2005 | Ishida | B25F 5/006 173/217 |
| 2007/0266831 | A1 | 11/2007 | Matthias et al. | |
| 2008/0257577 | A1 * | 10/2008 | Tanaka | B25B 21/00 173/4 |
| 2010/0181085 | A1 | 7/2010 | Imada et al. | |
| 2013/0277079 | A1 * | 10/2013 | Tsuzuki | B25F 5/006 173/162.2 |

FOREIGN PATENT DOCUMENTS

| | | | |
|---|---|---|---|
| DE | 29901003 | U1 | 4/1999 |
| DE | 202004020518 | U1 | 4/2006 |
| EP | 1382420 | A2 | 1/2004 |
| JP | 2002-254340 | A | 9/2002 |
| JP | 2005-199406 | A | 7/2005 |
| JP | 2005-254377 | A | 9/2005 |
| JP | 2009-028840 | A | 2/2009 |
| JP | 2009-083058 | A | 4/2009 |
| JP | 2011-036927 | A | 2/2011 |
| JP | 2012-196737 | A | 10/2012 |
| WO | WO2012090487 | A1 | 7/2012 |

OTHER PUBLICATIONS

International Report on Patentability for application PCT/JP2014/000040 (dated Jul. 30, 2015), 6 pages.
International Search Report for application PCT/JP2014/000040 (dated Jun. 5, 2014).
China Intellectual Property Office office action for patent application CN201480003785.6 (dated Jan. 7, 2016).

* cited by examiner

[Fig. 1]
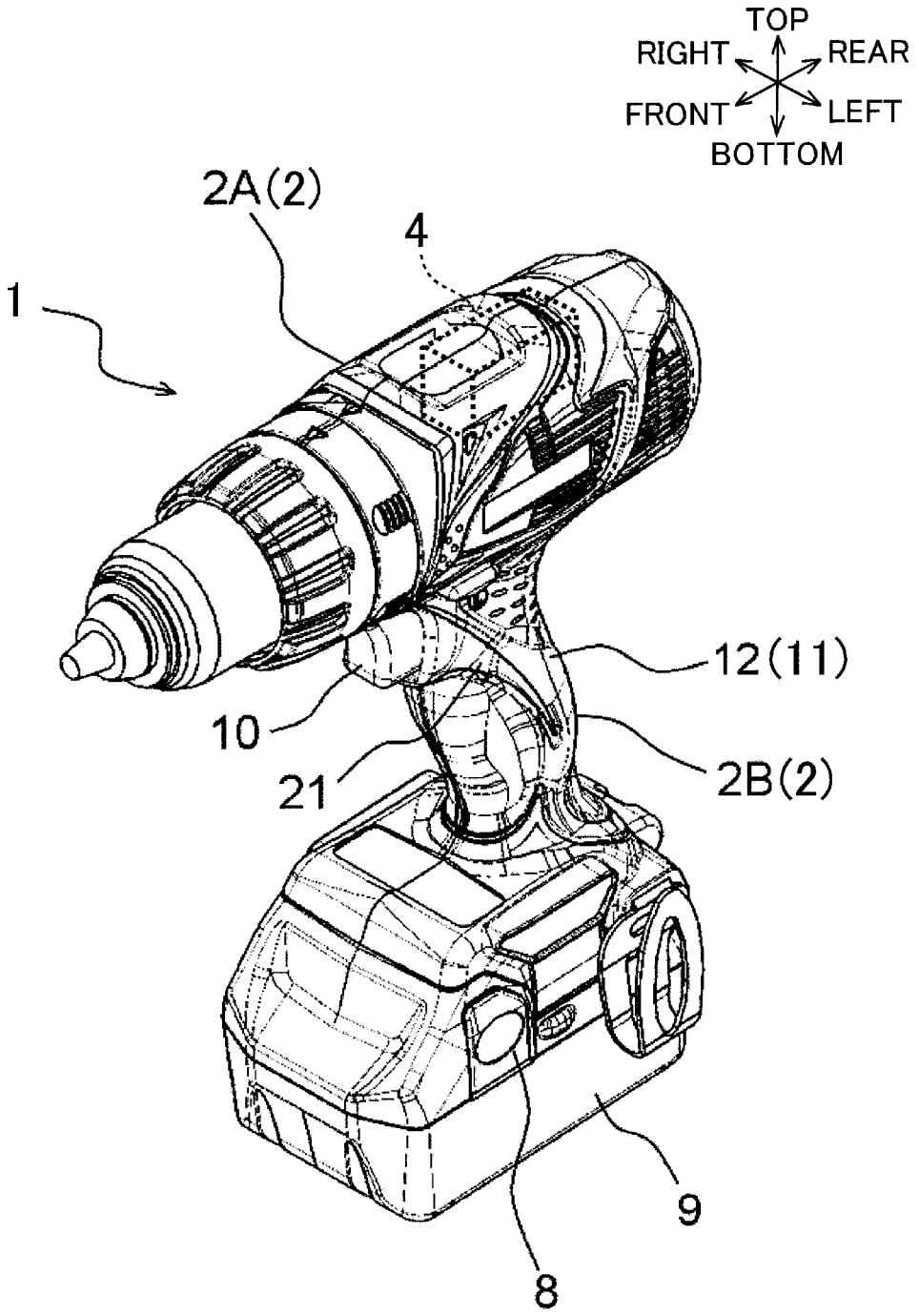

[Fig. 2]
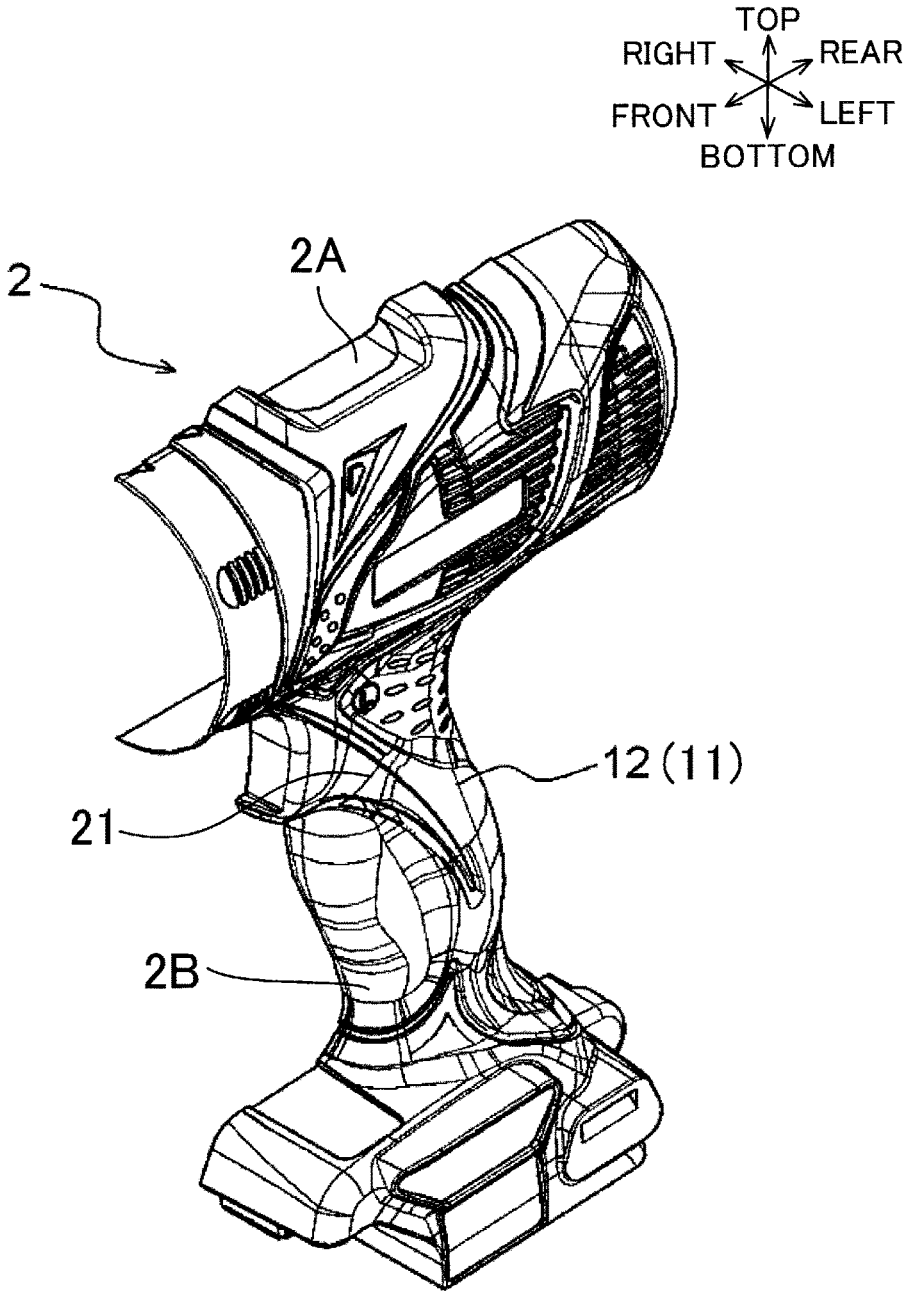

[Fig. 3]
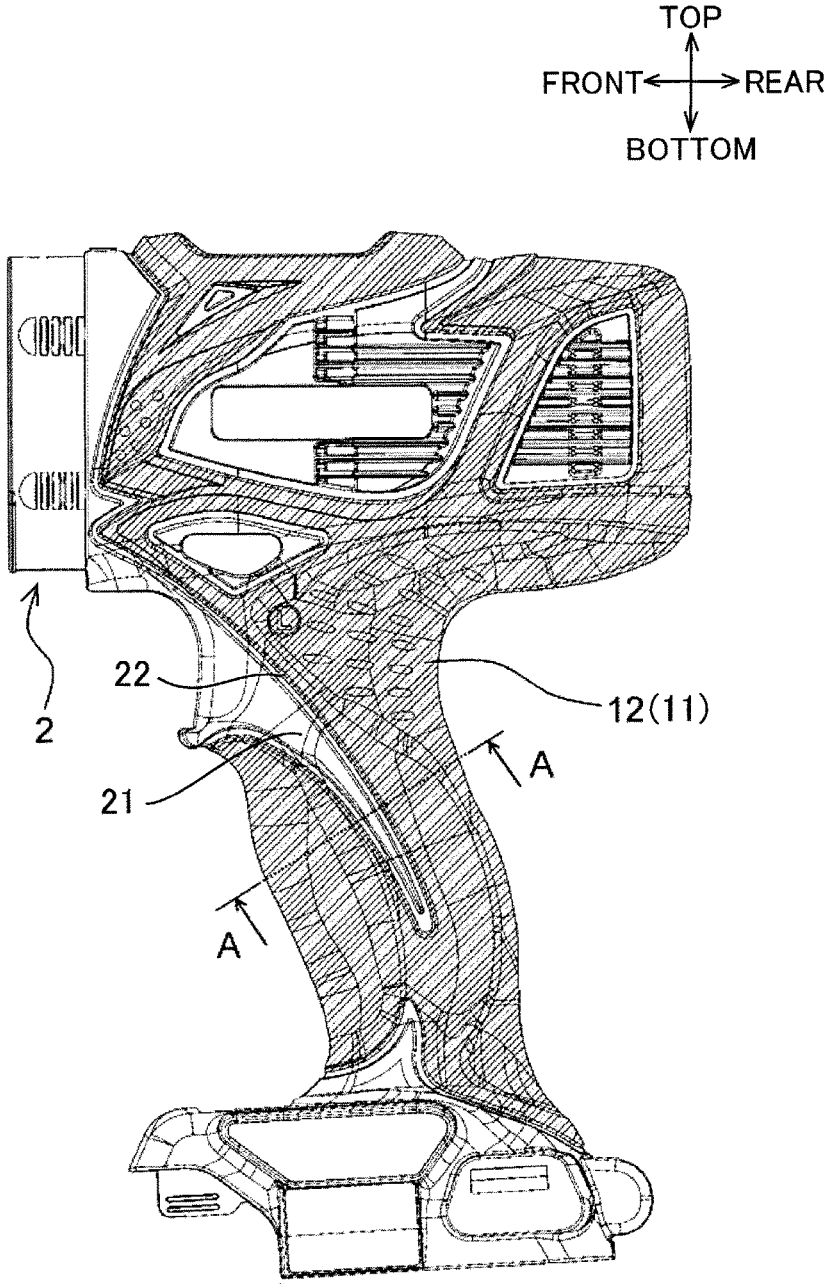

[Fig. 4]
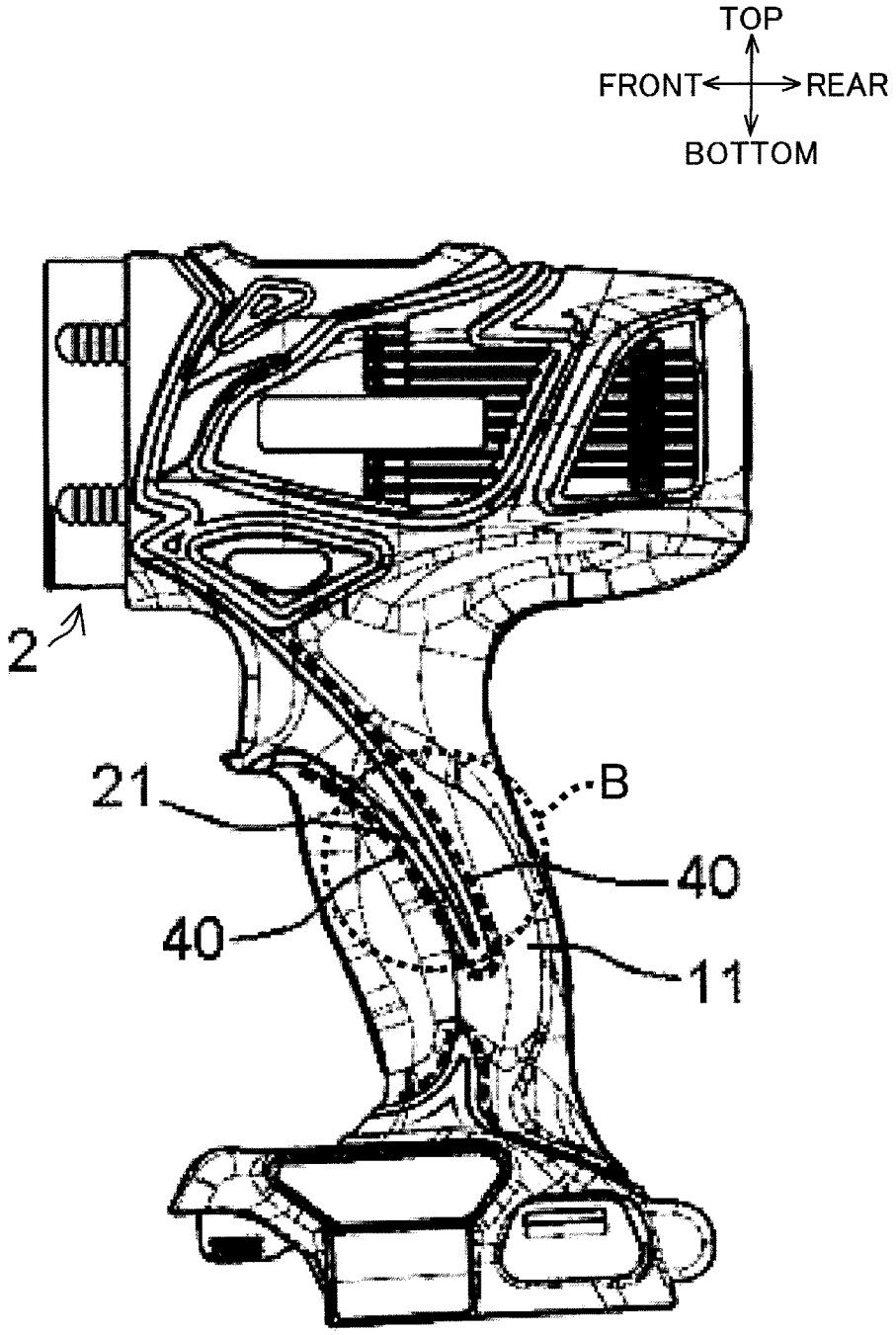

[Fig. 5]
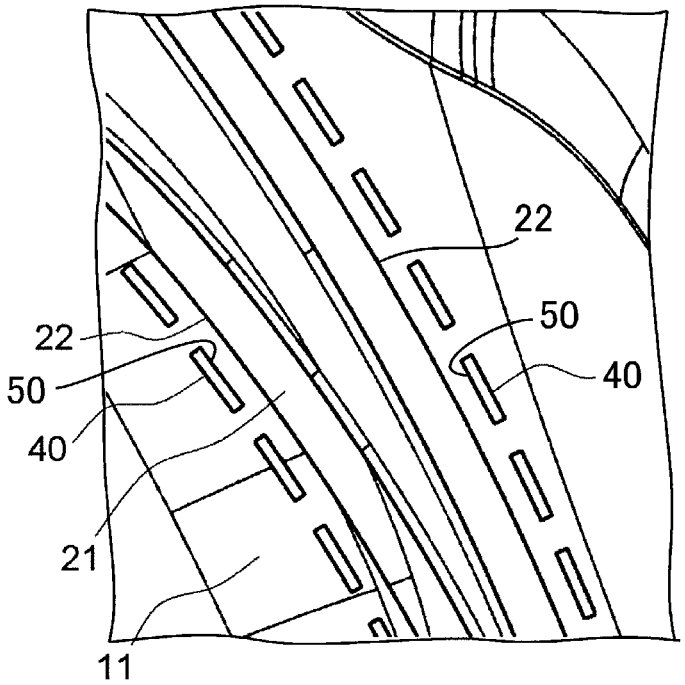
[Fig. 6]
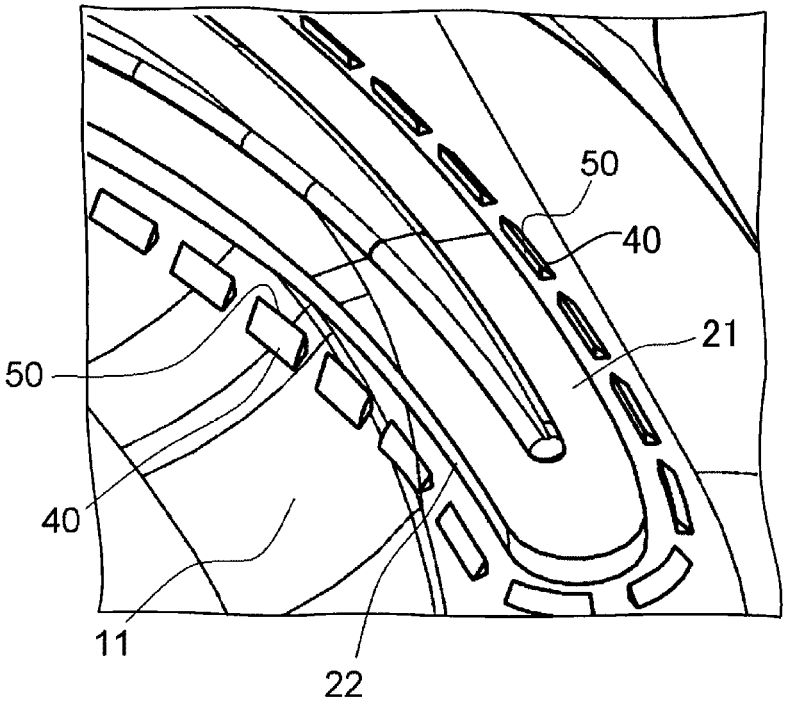

[Fig. 7]
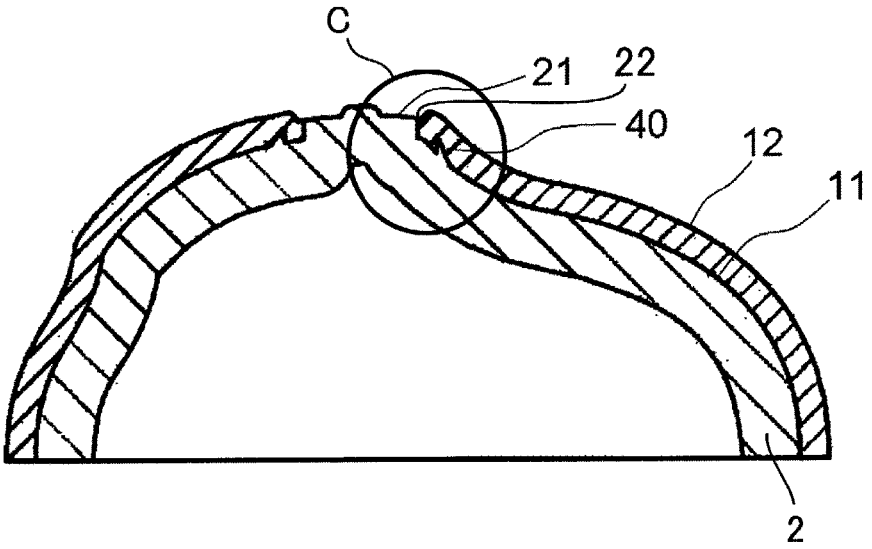
[Fig. 8]
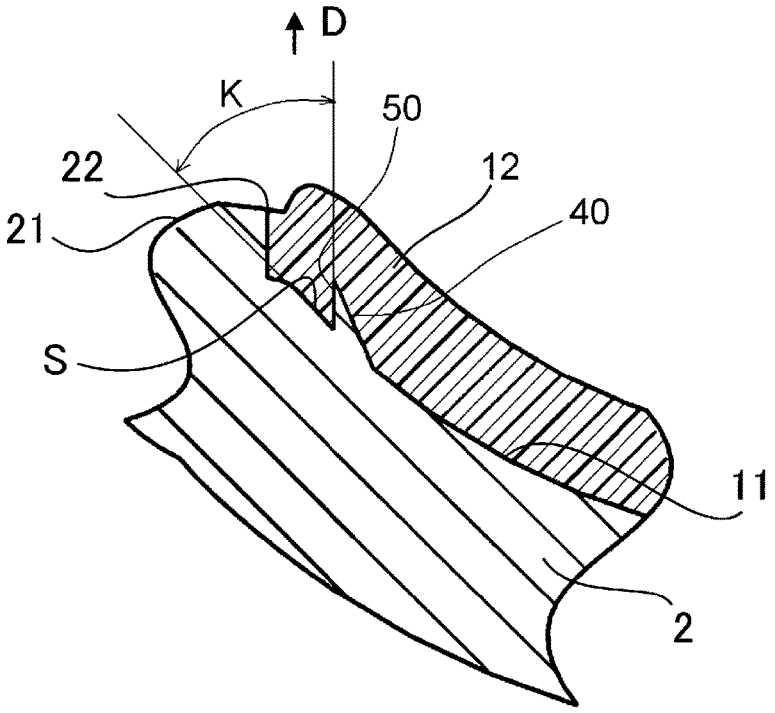

[Fig. 9]
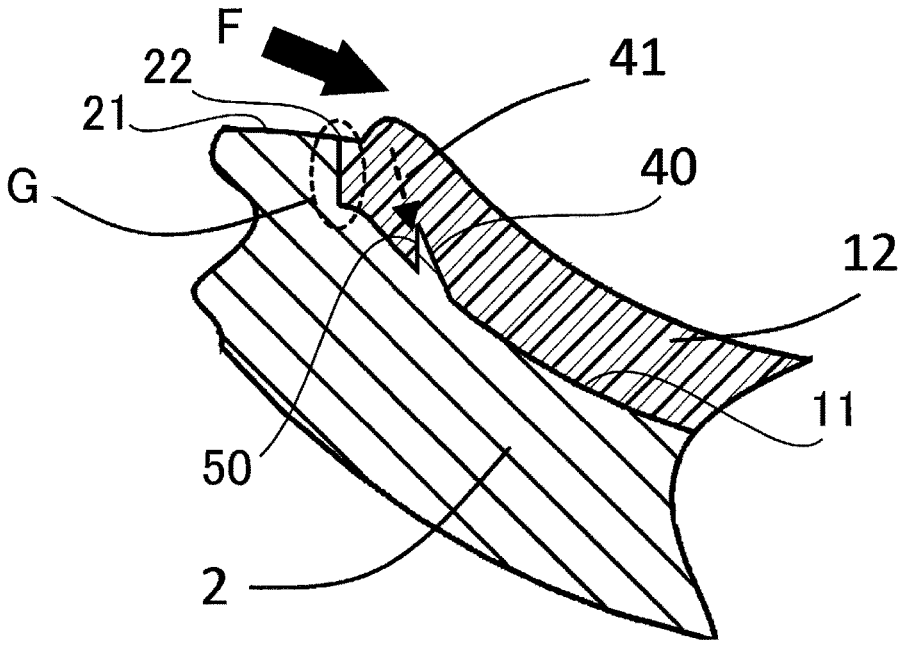
[Fig. 10A]
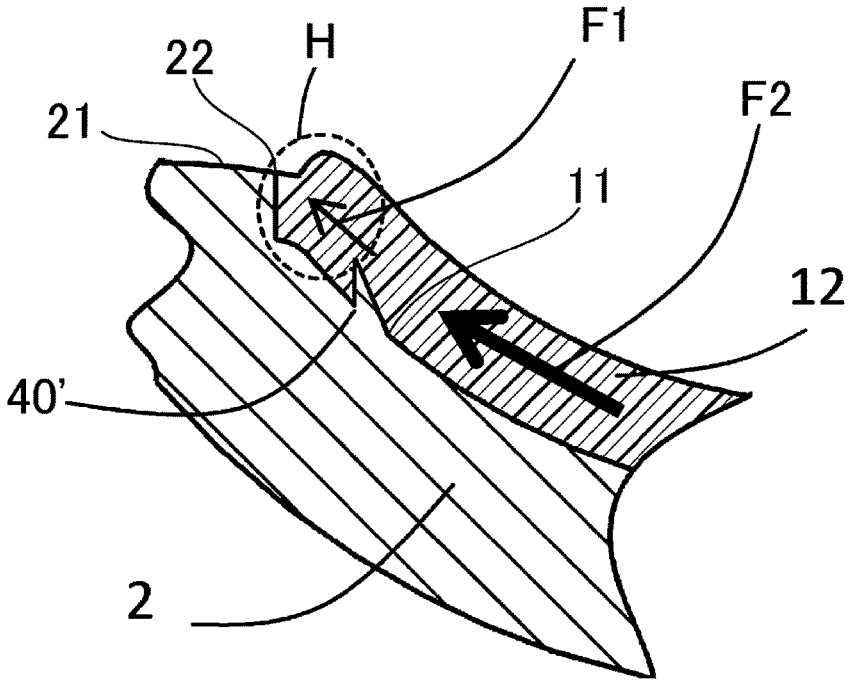

[Fig. 10B]
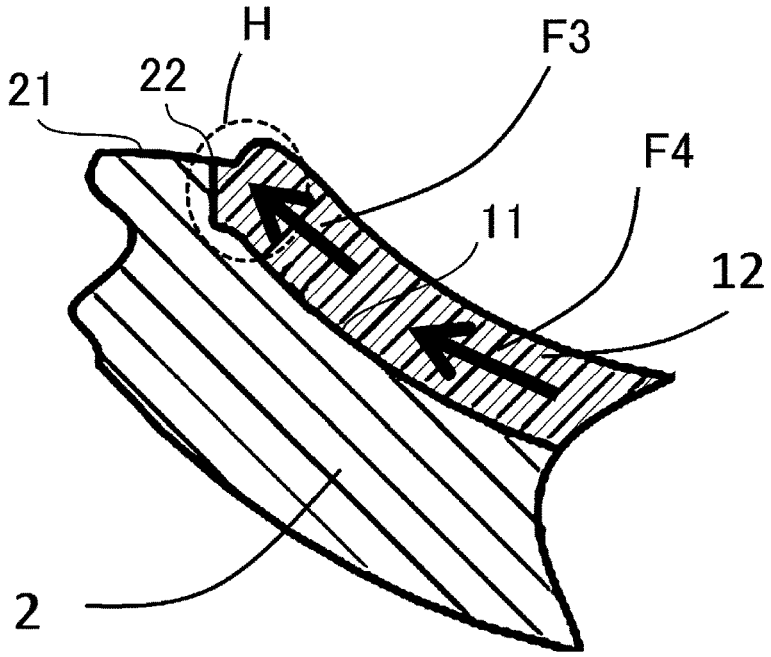
[Fig. 11]
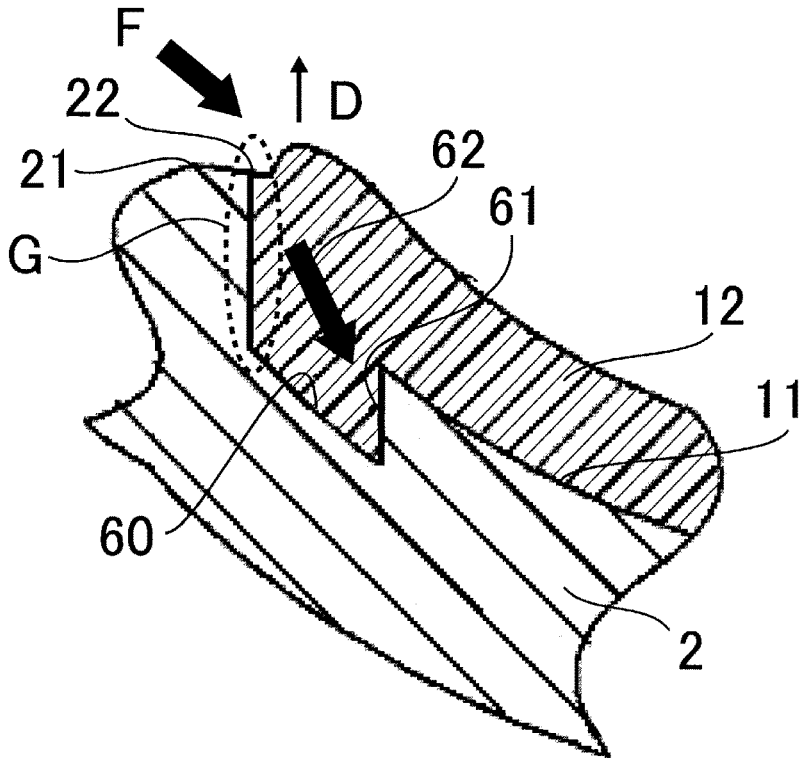

[Fig. 12]
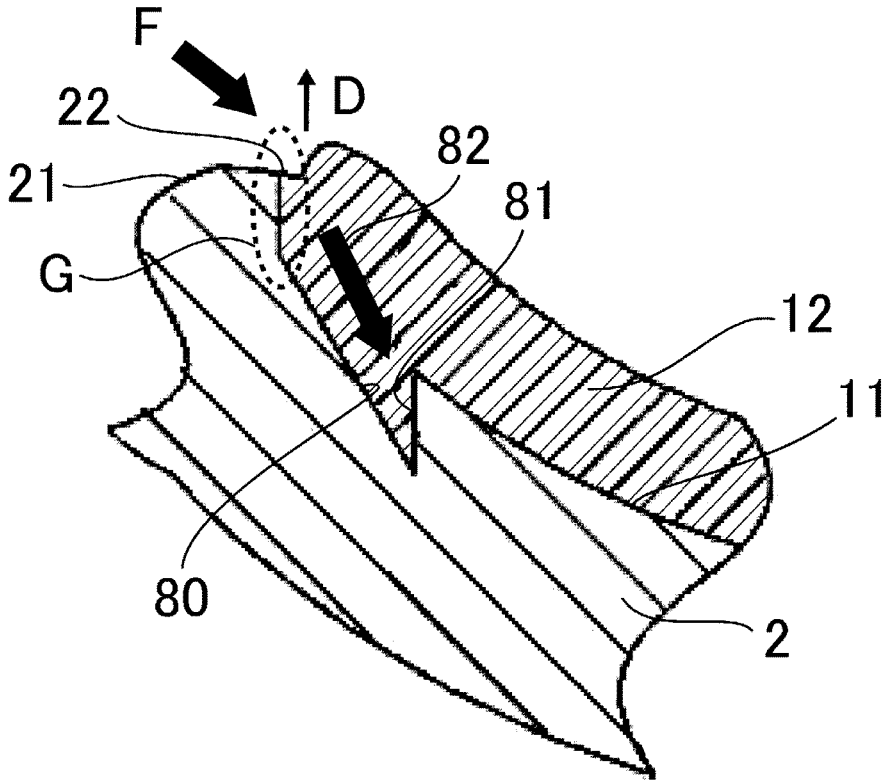

[Fig. 13]
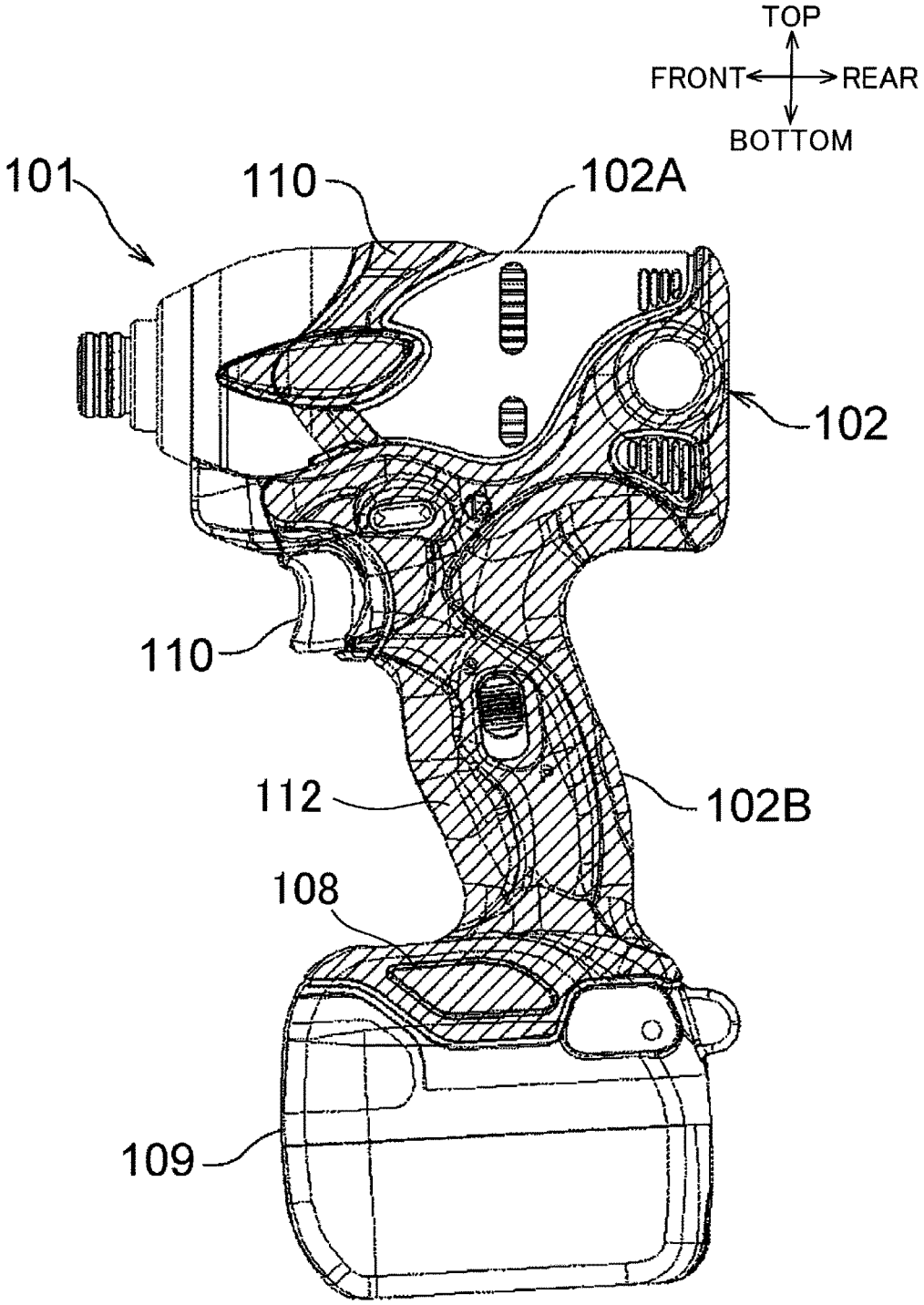

[Fig. 14]
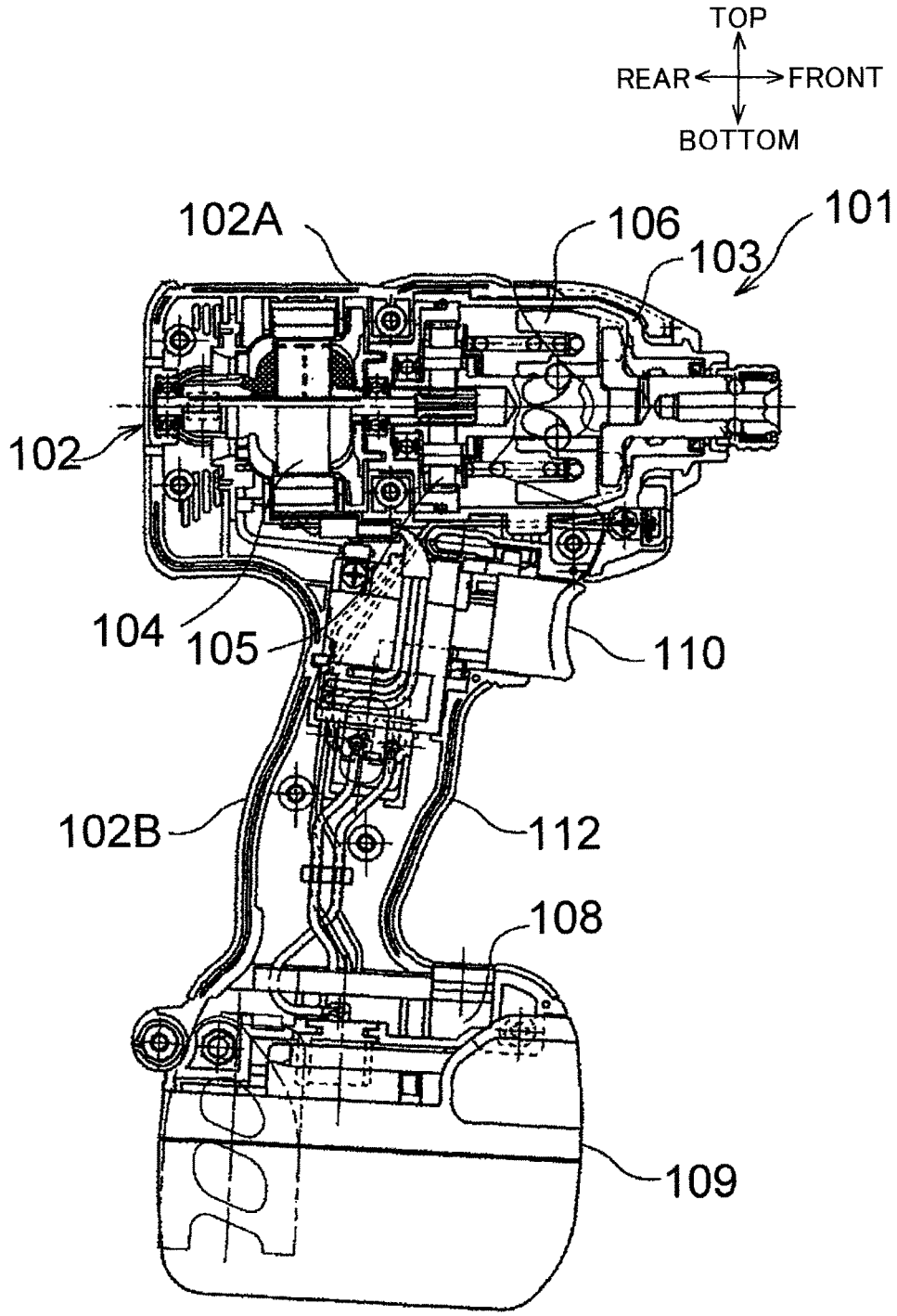

PORTABLE WORK TOOL

TECHNICAL FIELD

The present invention relates to a portable work tool including a housing whose outer surface is partially covered with a soft material.

BACKGROUND ART

There is conventionally known a portable work tool such as an impact driver for fastening a screw. Such a portable work tool includes a housing (outer frame) whose outer surface is partially covered with a layer made from a soft material. The portable work tool also includes a drive source such as a motor, a transmission mechanism configured to transmit a drive force generated by the drive source to an end bit, and a trigger switch configured to control the drive source, i.e., to start and stop the drive source. The housing includes a main body housing that accommodates the drive source and the transmission mechanism therein, and a handle housing that extends from the main body housing and accommodates the trigger switch therein.

As an example of such a conventional portable work tool, an impact driver 101 will be described while referring to FIGS. 13 and 14. In the following description, the left side in FIG. 13 will be defined as the front side, while the right side in FIG. 13 will be defined as the rear side. The top and bottom sides in FIG. 13 will be defined as the top and bottom sides, respectively. The left and right sides of the impact driver 101 will be based on the perspective of a user facing the rear side of the impact driver 101.

As shown in FIG. 13, the impact driver 101 includes a housing 102 serving as an outer frame thereof and defining an outer shape thereof, and a hammer casing 103 (FIG. 14). The housing 102 includes a main body housing 102A and a handle housing 102B. The main body housing 102A is formed substantially in a cylindrical shape, extending in a front-rear direction. The handle housing 102B continuously extends downward from the main body housing 102A, being formed substantially in a T-shape in a side view. As shown in FIG. 14, inside the main body housing 102A, the impact driver 101 includes a motor 104, a planetary gear mechanism 105, and an impact mechanism 106 are accommodated. The motor 104 serves as a drive source. The planetary gear mechanism 105 is adapted to decelerate rotation of the motor 104. The impact mechanism 106 is adapted to convert the rotation of the motor 104 decelerated by the planetary gear mechanism 105 into a rotational impact force to transmit the rotational impact force to an end bit (not illustrated).

A trigger switch 110 and a battery pack receiving portion 108 are provided at the handle housing 102B. The trigger switch 110 is disposed at an upper portion of the handle housing 102B and adapted to control the motor 104 to start and stop rotation of the motor 104. The battery pack receiving portion 108 is disposed at a lower portion of the handle housing 102B. A rechargeable battery pack 109 as a power source is detachably mounted at the battery pack receiving portion 108.

Outer surfaces of the main body housing 102A and the handle housing 102B of the housing 102 are partially covered with a soft layer 112 made from a soft elastic material, such as elastomer. A shaded portion in FIG. 13 represents a portion where the soft layer 112 covers the outer surface of the housing 102. The soft layer 112 is provided for the purpose of, for example, improving operability of the impact driver 101 while a user operates the impact driver 101 and protecting the impact driver 101 from external shock.

CITATION LIST

Patent Literature

PTL 1: Japanese Patent Application Publication No. 2009-83058

PTL 2: Japanese Patent Application Publication No. 2002-254340

DISCLOSURE OF INVENTION

Solution to Problem

In the impact driver 101 provided with the housing 102 as shown in FIGS. 13 and 14, the soft layer 112 is bonded to the outer surface of the housing 102 after the housing 102 is molded. This manufacturing method raises a problem such that, continued use of the impact driver 101 tends to impair bonding strength of the soft layer 112 relative to the outer surface of the housing 102, which causes the soft layer 112 coming off from the outer surface of the housing 102. As a result, good fitting feeling and softness of the impact driver 101 during the user's operation of the impact driver 101 are degraded.

In view of the foregoing, an object of the invention is to provide a portable work tool having a soft layer that is unlikely to come off from an outer surface of a housing of the portable work tool and ensuring good fitting feeling and softness of the portable work tool during operation by a user, with an inexpensive method.

In order to attain above and other object, the present invention provides a portable work tool including: a housing; a motor; and a restraining surface. The housing has an outer surface including a covered region that is covered with a soft layer and an uncovered region that is exposed to an outside. The covered region and the uncovered region define a boundary therebetween. The motor is accommodated in the housing. The restraining surface is disposed in proximity to the boundary and protrudes from the covered region.

This configuration prevents the soft layer from coming off from the outer surface of the housing, while improving an operability of the portable work tool and protecting the portable work tool from external shock.

It is preferable that the restraining surface is defined by a projection.

This configuration can restrain the soft layer from coming off from the outer surface of the housing.

It is preferable that the restraining surface includes a plurality of surfaces that is aligned along the boundary and arranged spaced apart from each other.

With this configuration, smooth flowing of the soft elastic material into an edge portion of the covered region positioned in proximity to and along the boundary can be facilitated when the soft layer is molded. Accordingly, filling failure of the soft elastic material into the edge portion of the covered region can be eliminated.

It is preferable that the restraining surface and the covered region define an angle therebetween, and the angle is smaller than 90 degrees.

This configuration prevents an edge portion of the soft layer from coming off from the outer surface of the housing.

It is preferable that the soft layer has a prescribed thickness, and the restraining surface protrudes from the covered region to define a protruding length of the restraining surface from the covered region. The protruding length is set to be within a range of one fifth of the prescribed thickness to two thirds of the prescribed thickness.

It is preferable that the protruding length is set to be within a range of one fourth of the prescribed thickness to one half of the prescribed thickness.

With this configuration, the restraining surface of the projection can restrain the edge portion of the soft layer from coming off from the outer surface of the housing, while the thickness of the soft layer at a portion covering the projection is prevented from being thin.

It is preferable that the soft layer has a prescribed thickness, and the restraining surface is spaced away from the boundary by a prescribed distance. The prescribed distance is set to be within a range of one fourth of the prescribed thickness to three fourths of the prescribed thickness.

It is preferable that the prescribed distance is set to be within a range of one third of the prescribed thickness to two thirds of the prescribed thickness.

With this configuration, deformation of the edge portion of the soft layer can be prevented. Further, the restraining surface does not become an obstacle to the soft elastic material flowing into a portion of the covered region between the restraining surfaces and the boundary when the soft layer is molded.

It is preferable that the restraining surface is defined by a groove.

It is preferable that the restraining surface is defined by a notch.

ADVANTAGEOUS EFFECTS OF INVENTION

According to the present invention described above can provide, with an inexpensive method, a portable work tool that can restrain a soft layer covering at least a part of an outer surface of a housing of the portable work tool from coming off from the outer surface, by providing a restraining surface that protrudes from the outer surface of the housing. The restraining surface is provided in a covered region of the outer surface covered with the soft layer, while extending along a boundary between the covered region and an uncovered region of the outer surface exposed to an outside.

BRIEF DESCRIPTION OF DRAWINGS

FIG. 1 is a perspective view of a drill driver as a portable work tool according to one embodiment of the present invention;

FIG. 2 is a perspective view of a left half portion of a housing of the driver drill in FIG. 1;

FIG. 3 is a left side view of the housing in FIG. 2;

FIG. 4 is a left side view of the housing in FIG. 3 from which a soft layer is omitted;

FIG. 5 is an enlarged view of a portion B marked by a circle in FIG. 4;

FIG. 6 is an enlarged perspective view of the portion B marked by the circle of FIG. 4;

FIG. 7 is a cross-sectional view of the housing taken along a line A-A in FIG. 3;

FIG. 8 is an enlarged view of a portion C marked by a circle in FIG. 7;

FIG. 9 is an explanatory view illustrating a state where a force rubbing an outer surface of the housing is applied to an edge portion of the soft layer;

FIG. 10A is an explanatory view illustrating fluid motion of a soft material when molding the soft layer according to a comparative example of the embodiment;

FIG. 10B is an explanatory view illustrating fluid motion of a soft material when molding the soft layer according to the embodiment;

FIG. 11 is a view showing a part of a housing of a portable work tool according to a first modification of the present invention;

FIG. 12 is a view showing a part of a housing of a portable work tool according to a second modification of the present invention;

FIG. 13 is a left side view of a conventional portable work tool (impact driver); and FIG. 14 is a cross-sectional view of the conventional portable work tool showing an internal structure thereof as viewed from a right side.

BEST MODE FOR CARRYING OUT THE INVENTION

A drill driver as a portable work tool according to one embodiment of the present invention will be described while referring to FIGS. 1 through 10B wherein like parts and components are designated by the same reference numerals to avoid duplicating description. Note that the portable work tool is not limited to the drill driver, in so far as the tool has a configuration for achieving the same advantageous effects obtained by the drill driver according to the embodiment of the present invention.

In the following description, the terms "upward", "downward", "upper", "lower", "above", "below", "beneath", "right", "left", "front", "rear" and the like will be used based on the perspective of the user, as indicated by direction arrows in FIG. 1.

The drill driver 1 has an internal configuration similar to the internal configuration of the conventional impact driver 101 described above. Accordingly, only parts and components differing from those of the above-described conventional impact driver 101 will be described in detail to avoid duplicating description.

As shown in FIG. 1, the drill driver 1 includes a housing 2 serving as an outer frame. The housing 2 includes a main body housing 2A and a handle housing 2B. A motor 4 as a drive source is accommodated in the main body housing 2A. The handle housing 2B extends downward from the main body housing 2A. The handle housing 2B has an upper end portion at which a trigger switch 10 is provided, and a bottom end portion at which a battery pack receiving portion 8 is provided. A rechargeable battery pack 9 is detachably mounted at the battery pack receiving portion 8.

An outer surface of the housing 2 comprised from the main body housing 2A and the handle housing 2B has a region covered with a soft layer 12 made from a soft elastic material, such as elastomer. The soft layer 12 is provided for the purpose of improving operability of the drill driver 1 when a user operates the drill driver 1. The soft layer 12 is provided also for the purpose of protecting the drill driver 1 from external shock. In order to enhance a slip-proof effect and a shock-resistant effect on the soft layer 12, as shown in FIGS. 2 and 3, the outer surface of the housing 2 has a covered region 11 that is covered with the soft layer 12, and an uncovered region 21 that is not covered with the soft layer 12 and thus exposed to an outside. In FIG. 3, a shaded portion represents the covered region 11. As shown in FIG. 3, the covered region 11 and the uncovered region 21 define a boundary 22 therebetween.

As shown in FIG. 4, the housing 2 has a plurality of projections 40 disposed in the covered region 11. The plurality of projections 40 is aligned in proximity to and along the boundary 22. More specifically, the projections 40 are disposed inside and in proximity to a contour of the covered region 11. The projections 40 are intermittently aligned along the contour of the covered region 11.

As shown in FIGS. 5 and 6, each projection 40 has a surface facing to a side where the boundary 22 is located. This surface of the projection 40 serves as a restraining surface 50. The restraining surfaces 50 are aligned along the boundary 22 and arranged spaced apart from each other. Each restraining surface 50 protrudes from the covered region 11 of the housing 2 in a direction substantially parallel to a die opening direction D for taking out a molded product (i.e. housing 2) from a die, as shown in FIG. 8. As shown in FIG. 8, an angle K is defined between the restraining surface 50 and the covered region 11 of the housing 2. More specifically, the covered region 11 has a surface S located between the restraining surface 50 and the contour of the covered region 11. The angle K is an angle between the restraining surface 50 and the surface S of the covered region 11. In the present embodiment, the angle K is set to be equal to or less than 90 degrees. More specifically, in FIG. 8, the angle K is 55 degrees.

Each restraining surface 50 is designed so as to have a height (protruding length) from the covered region 11 of the housing 2 within a range of one fifth (⅕) of a thickness of the soft layer 12 to two thirds (⅔) of the thickness of the soft layer 12. More preferably, the restraining surface 50 is designed so as to have the height from the covered region 11 of the housing 2 within a range of one fourth (¼) of the thickness of the soft layer 12 to one half (½) of the thickness of the soft layer 12. In the preferred embodiment, the height of the restraining surface 50 is set to be substantially one third (⅓) of the thickness of the soft layer 12. If the height of each restraining surface 50 is lower than the preferred height, the soft layer 12 may not be caught by the projections 40, with the result that the projections 40 are less likely to restrain an edge portion of the soft layer 12 extending along a contour thereof from coming off from the housing 2. On the contrary, if the height of each restraining surface 50 is higher than the preferred height, the thickness of the soft layer 12 at portions covering the projections 40 becomes thin.

In addition, each restraining surface 50 is designed so as to be spaced away from the boundary 22 (i.e. the contour of the covered region 11) by a distance within a range of one fourth (¼) of the thickness of the soft layer 12 to three fourths (¾) of the thickness of the soft layer 12. More preferably, the restraining surface 50 is designed so as to be spaced away from the boundary 22 by a distance within a range of one third (⅓) of the thickness of the soft layer 12 to two thirds (⅔) of the thickness of the soft layer 12. In the preferred embodiment, the restraining surface 50 is set to be spaced away from the boundary 22 substantially by a distance of one half (½) of the thickness of soft layer 12, so that the restraining surface 50 can receive a force 41 (described later) effectively. If each restraining surface 50 is spaced away from the boundary 22 by a distance greater than the preferred distance, prevention of deformation of the edge portion of the soft layer 12 can be less likely achieved. If each restraining surface 50 is spaced away from the boundary 22 only by a distance smaller than the preferred distance, each restraining surface 50 may be an obstacle to the soft elastic material flowing into an edge portion of the covered region 11 extending along the contour thereof when molding the soft layer 12.

As shown in FIG. 9, while a user operates the drill driver 1, the user applies a grip force to the outer surface of the housing 2. Such a grip force by the user generates a force F rubbing the outer surface of the housing 2 during the operation of the drill driver 1. The force F travels in the soft layer 12 as the force 41, and the force 41 is transmitted to the restraining surface 50 of each projection 40. Then, the force 41 is effectively received by the restraining surface 50 of each projection 40. As a result, a tension force at a bonding surface G where the edge portion of the soft layer 12 is bonded to the housing 2 (i.e. surface at the boundary 22) does not exceed a bonding strength of the soft layer 12 relative to the housing 2. Hence, the soft layer 12 is unlikely to come off from the outer surface of the housing 2.

Incidentally, the restraining surface 50 is not necessarily a flat surface. As long as the restraining surface 50 can restrain the soft layer 12 from coming off from the outer surface of the housing 2 and also can restrain the edge portion of the soft layer 12 from being deformed, any shape is applicable to the restraining surface 50. For example, the restraining surface 50 may be a curved surface to form a columnar shaped projection 40.

Further, in the present embodiment, as described above, the plurality of projections 40 is intermittently disposed along the boundary 22. That is, the plurality of projections 40 is arranged spaced apart from each other. Hence, the soft elastic material forming the soft layer 12 can smoothly flow into an edge portion of the covered region 11 extending along the contour thereof (along the boundary 22) through gaps between the neighboring projections 40, when the soft layer 12 is formed by molding.

While referring to FIGS. 10A and 10B, how the projections 40 facilitate smooth flowing of the soft elastic material into the edge portion of the covered region 11 upon molding the soft layer 12 will be described.

FIG. 10A shows a comparative example of the present embodiment. In the comparative example, it is assumed that a projection 40' extends continuously along the boundary 22 (along the contour of the covered region 11) without gaps. The projection 40' blocks smooth flowing of the soft elastic material, and therefore, the soft elastic material flows less smoothly at a position downstream of the projection 40' in a flowing direction of the soft elastic material (see an arrow F1 in FIG. 10A) than at a position upstream of the projection 40' in the flowing direction (see an arrow F2 in FIG. 10A). Hence, the projection 40' degrades smooth flowing of the soft elastic material in the edge portion of the covered region 11 marked by a chain-line circle H in FIG. 10A.

FIG. 10B shows the present embodiment and illustrates a cross-section of a portion of the housing 2 where the gap between the two neighboring projections 40 is formed. The gaps between the neighboring projections 40 facilitate smooth flowing of the soft elastic material even at the position downstream of the projections 40 in the flowing direction. With this configuration, the soft elastic material flows at the position downstream of the projections 40 in the flowing direction (see an arrow F3 in FIG. 10B) as smoothly as that flows at the position upstream of the projections 40 in the flowing direction (see an arrow F4 in FIG. 10B). As described above, since the projections 40 are arrayed at intervals along the boundary 22 (i.e. along the contour of the covered region 11), the soft elastic material can be sufficiently supplied onto the edge portion of the covered region 11 marked by the chain-line circle H in FIG. 10B through the gaps between the neighboring projections 40. Accordingly, filling failure of the soft elastic material into the edge portion of the covered region 11 can be eliminated.

Further, various modifications are conceivable.

In the above-described embodiment, the restraining surface 50 is defined by the projection 40. However, as shown in FIG. 11, a restraining surface 61 may be defined by a groove 60 formed in the covered region 11. Alternatively, as shown in FIG. 12, a restraining surface 81 may be defined by a notch 80 formed in the covered region 11.

As shown in FIG. 11, the groove 60 is recessed into the covered region 11 of the housing 2 in the direction substantially parallel to the die opening direction D, and formed in proximity to and along the boundary 22. The groove 60 is disposed inside and in proximity to the contour of the covered region 11. The groove 60 has a generally parallelogram shaped cross-section. The restraining surface 61 extends in the direction substantially parallel to the die opening direction D, similar to the restraining surface 50. When the user applies a grip force to the outer surface of the housing 2, and such a grip force generates the force F rubbing the outer surface of the housing 2 during the operation of the drill driver 1, the force F travels in the soft layer 12 as a force 62. The force 62 is transmitted to the restraining surface 61 of the groove 60, and then, the force 62 is effectively received by the restraining surface 61 of the groove 60. As a result, a tension force at the bonding surface G where the edge portion of the soft layer 12 is bonded to the housing 2 does not exceed a bonding strength of the soft layer 12 relative to the housing 2. Hence, the soft layer 12 is unlikely to come off from the outer surface of the housing 2.

The notch 80 cuts into the outer surface of the housing 2 in the direction substantially parallel to the die opening direction D, and is formed in proximity to and along the boundary 22. The notch 80 is disposed inside and in proximity to the contour of the covered region 11. The groove 80 has a generally triangle shaped cross-section. The restraining surface 81 extends in the direction substantially parallel to the die opening direction D, similar to the restraining surface 50. When the user applies a grip force to the outer surface of the housing 2, and such a grip force generates the force F rubbing the outer surface of the housing 2 during the operation of the drill driver 1, the force F travels in the soft layer 12 as a force 82. The force 82 is transmitted to the restraining surface 81 of the notch 80, and then, the force 82 is effectively received by the restraining surface 81 of the notch 80. As a result, a tension force at the bonding surface G where the edge portion of the soft layer 12 is bonded to the housing 2 does not exceed a bonding strength of the soft layer 12 relative to the housing 2. Hence, the soft layer 12 is unlikely to come off from the outer surface of the housing 2.

These modifications of the above-described embodiment can obtain the same operational advantages described in the embodiment.

In the above-described embodiment, the drill driver 1 is described as an example of the portable work tool. However, any work tools other than the drill driver, such as an impact driver, a grinder, a cutter, a blower, a hedge trimmer and a chain saw, are available in the present invention.

Further, as a drive source accommodated in the housing 2, an engine may be used instead of the motor 4.

While the present invention has been described in detail with reference to the embodiment thereof, it would be apparent to those skilled in the art that various changes and modifications may be made therein without departing from the spirit of the present invention.

INDUSTRIAL APPLICABILITY

The present invention is available for a portable work tool, such as a drill driver, an impact driver, a grinder, a cutter, a blower, a hedge trimmer and a chain saw.

REFERENCE SIGNS LIST

1: drill driver, 2: housing, 2A: main body housing, 2B: handle housing, 4: motor, 8: battery pack receiving portion, 9: battery pack, 10: trigger switch, 11: covered region, 12: soft layer, 21: uncovered region, 22: boundary, 40: projection, 41: force, 50: restraining surface, 60: groove, 61: restraining surface, 62: force

The invention claimed is:

1. A portable work tool comprising:

a housing having an outer surface including a covered region that is covered with a soft layer and an uncovered region that is exposed to an outside, the soft layer being molded over the covered region, the covered region and the uncovered region defining a boundary therebetween;

a motor accommodated in the housing; and a restraining surface disposed in proximity to the boundary and protruding from the covered region, the restraining surface comprises a plurality of surfaces that are aligned along the boundary and arranged spaced apart from each other.

2. The portable work tool as claimed in claim 1, wherein the restraining surface is defined by a projection.

3. The portable work tool as claimed in claim 1, wherein the restraining surface and the covered region define an angle therebetween, the angle being smaller than 90 degrees.

4. The portable work tool as claimed in claim 1, wherein the soft layer has a prescribed thickness, wherein the restraining surface protrudes from the covered region to define a protruding length of the restraining surface from the covered region, the protruding length being set to be within a range of one fifth of the prescribed thickness to two thirds of the prescribed thickness.

5. The portable work tool as claimed in claim 4, wherein the protruding length is set to be within a range of one fourth of the prescribed thickness to one half of the prescribed thickness.

6. The portable work tool as claimed in claim 1, wherein the soft layer has a prescribed thickness, wherein the restraining surface is spaced away from the boundary by a prescribed distance, the prescribed distance being set to be within a range of one fourth of the prescribed thickness to three fourths of the prescribed thickness.

7. The portable work tool as claimed in claim 6, wherein the prescribed distance is set to be within a range of one third of the prescribed thickness to two thirds of the prescribed thickness.

8. The portable work tool as claimed in claim 1, wherein the restraining surface is defined by a groove.

9. The portable work tool as claimed in claim 1, wherein the restraining surface is defined by a notch.

10. A portable work tool comprising:

a housing having an outer surface, the outer surface including:

a covered region that is covered with a soft layer, the soft layer being molded over the covered region; and an uncovered region that is exposed to an outside, the covered region and the uncovered region defining a boundary therebetween;

a motor accommodated in the housing; and a plurality of projections disposed in proximity to and spaced apart from the boundary, the plurality of projections protruding from the covered region in a direction away from the outer surface, the plurality of projections being aligned along the boundary and arranged spaced apart from each other, the plurality of projections partitioning the covered region into a first part and a second part, the second part being farther from the boundary than the first part from the boundary, the first part being positioned at a height lower than the uncovered region, a protruding end of each of the plurality of projections being provided at a position higher than the first part and the second part.

11. The portable work tool as claimed in claim 10, wherein the plurality of projections each has a restraining surface protruding from the covered region in the direction away from the outer surface and facing the boundary.

12. The portable work tool as claimed in claim 11, wherein the covered region has a surface located between the restraining surface and the boundary, wherein the restraining surface and the surface of the covered region define an angle therebetween, the angle being smaller than 90 degrees.

13. The portable work tool as claimed in claim 11, wherein the soft layer has a prescribed thickness, wherein the restraining surface protrudes from the covered region to define a protruding length of the restraining surface from the covered region, the protruding length being set to be within a range of one fifth of the prescribed thickness to two thirds of the prescribed thickness.

14. The portable work tool as claimed in claim 13, wherein the protruding length is set to be within a range of one fourth of the prescribed thickness to one half of the prescribed thickness.

15. The portable work tool as claimed in claim 11, wherein the soft layer has a prescribed thickness, wherein the restraining surface is spaced away from the boundary by a prescribed distance, the prescribed distance being set to be within a range of one fourth of the prescribed thickness to three fourths of the prescribed thickness.

16. The portable work tool as claimed in claim 15, wherein the prescribed distance is set to be within a range of one third of the prescribed thickness to two thirds of the prescribed thickness.

* * * * *